US009514666B2

(12) United States Patent
Huang et al.

(10) Patent No.: US 9,514,666 B2
(45) Date of Patent: Dec. 6, 2016

(54) IMAGE DISPLAY SYSTEM AND DISPLAY DRIVING MODULE

(71) Applicant: Novatek Microelectronics Corp., Hsinchu (TW)

(72) Inventors: Ju-Lin Huang, Hsinchu County (TW); Jhih-Siou Cheng, New Taipei (TW); Chun-Yung Cho, Hsinchu County (TW); Chia-En Wu, New Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 106 days.

(21) Appl. No.: 14/645,434

(22) Filed: Mar. 12, 2015

(65) Prior Publication Data

US 2015/0339960 A1 Nov. 26, 2015

(30) Foreign Application Priority Data

May 22, 2014 (TW) ..... 103117943 A

(51) Int. Cl.
*G09G 5/00* (2006.01)
*G09G 3/20* (2006.01)

(52) U.S. Cl.
CPC ..... *G09G 3/20* (2013.01); *G09G 2330/04* (2013.01); *G09G 2330/06* (2013.01)

(58) Field of Classification Search
CPC G09G 3/006; G09G 2330/04; G09G 2330/06; G09G 2330/21; H01L 23/60; H05K 9/0067
See application file for complete search history.

(56) References Cited

U.S. PATENT DOCUMENTS 6,043,971 A * 3/2000 Song ..... G02F 1/136204 349/40
7,115,952 B2 * 10/2006 Woo ..... H01F 17/0006 257/355

(Continued)

FOREIGN PATENT DOCUMENTS

CN 1916710 2/2007
CN 201845146 5/2011

(Continued)

OTHER PUBLICATIONS

"Office Action of Taiwan Counterpart Application", issued on May 4, 2015, p. 1-p. 8, in which the listed references were cited.

*Primary Examiner* — Joe H Cheng
(74) *Attorney, Agent, or Firm* — Jianq Chyun IP Office

(57) ABSTRACT

A display driving module including a driving circuit portion and a non-driving circuit portion is provided. The driving circuit portion is controlled by a system circuit block. The driving circuit portion includes driving channels for driving a display panel. First ESD protection devices are disposed in the driving circuit portion corresponding to the driving channels for providing at least one discharge path. The non-driving circuit portion electrically connects the system circuit block, the driving circuit portion and the display panel. At least one of second ESD protection devices is disposed in at least one of the driving circuit portion, the non-driving circuit portion, the system circuit block and the display panel corresponding to the first ESD protection devices. The second ESD protection devices cooperate with the first ESD protection devices to provide the discharge path. An image display system including the foregoing display driving module is also provided.

18 Claims, 5 Drawing Sheets

(56) References Cited

U.S. PATENT DOCUMENTS

| | | | | |
|---|---|---|---|---|
| 7,551,240 | B2 | 6/2009 | Tsai et al. | |
| 8,350,841 | B2 * | 1/2013 | Li | G09G 3/20 345/211 |
| 9,183,795 | B2 * | 11/2015 | Jun | G09G 3/36 |
| 2004/0264080 | A1 * | 12/2004 | Yang | H02H 9/046 361/56 |
| 2007/0103423 | A1 * | 5/2007 | Tsai | G09G 3/2096 345/100 |
| 2008/0094533 | A1 * | 4/2008 | Ker | H01L 29/7436 349/40 |
| 2008/0253045 | A1 * | 10/2008 | Sato | H01L 27/0251 361/56 |
| 2011/0243120 | A1 * | 10/2011 | Ginsburg | G06K 7/10237 370/345 |
| 2013/0120334 | A1 * | 5/2013 | Kim | G09G 3/3688 345/208 |
| 2014/0167170 | A1 * | 6/2014 | Kuo | H01L 27/0288 257/355 |
| 2015/0333508 | A1 * | 11/2015 | Ko | H01L 23/60 361/56 |

FOREIGN PATENT DOCUMENTS

| | | |
|---|---|---|
| TW | I238376 | 8/2005 |
| TW | I318700 | 12/2009 |
| TW | I346807 | 8/2011 |
| TW | 201143026 | 12/2011 |

* cited by examiner

IMAGE DISPLAY SYSTEM AND DISPLAY DRIVING MODULE

CROSS-REFERENCE TO RELATED APPLICATION

This application claims the priority benefit of Taiwan application serial no. 103117943, filed on May 22, 2014. The entirety of the above-mentioned patent application is hereby incorporated by reference herein and made a part of this specification.

BACKGROUND OF THE DISCLOSURE

1. Field of the Disclosure

The disclosure relates to an image display system and a display driving module thereof, and more particularly, relates to an image display system with electrostatic discharge (ESD) protection function and a display driving module thereof.

2. Description of Related Art

Generally, in an image display system, an ESD protection test is usually required after manufacturing process of a display driving chip for driving a display panel is completed. The ESD protection test includes, for example, inputting a test signal to a test pad, so as to test a capability to withstand electrostatic discharge for the display driving chip. The display driving chip with poor capability to withstand electrostatic discharge is prone to damages during the test. Therefore, in order to improve the capability to withstand electrostatic discharge for the display driving chip, a method of directly adjusting a layout area of original ESD protection devices inside the display driving chip is proposed in the conventional art. However, because such method may significantly increase an area cost for the display driving chip, it is still insufficient for practical application even though the capability to withstand electrostatic discharge for the display driving chip can be increased.

SUMMARY OF THE DISCLOSURE

The disclosure is directed to an image display system and a display driving module thereof, and capable of providing a favorable ESD protection function while providing cost effectiveness.

The display driving module of the disclosure includes a driving circuit portion and a non-driving circuit portion. The driving circuit portion is controlled by a system circuit block. The driving circuit portion includes one or more driving channels configured to drive a display panel. One or more first ESD protection devices are disposed in the driving circuit portion corresponding to the driving channels configured to provide at least one discharge path. The non-driving circuit portion electrically connects the system circuit block, the driving circuit portion and the display panel. At least one of one or more second ESD protection devices is disposed in at least one of the driving circuit portion, the non-driving circuit portion, the system circuit block and the display panel corresponding to the first ESD protection devices. The second ESD protection devices cooperate with the corresponding first ESD protection devices to provide the at least one discharge path.

An image display system of the disclosure includes a display panel, a display driving module and a system circuit block. The display panel displays an image frame. The display driving module includes a driving circuit portion and a non-driving circuit portion. The driving circuit portion includes one or more driving channels configured to drive the display panel to display the image frame. One or more first ESD protection devices are disposed in the driving circuit portion corresponding to the driving channels configured to provide at least one discharge path. The non-driving circuit portion electrically connects the system circuit block, the driving circuit portion and the display panel. The system circuit block provides a plurality of system control signals to control the display driving module. At least one of one or more second ESD protection devices is disposed in at least one of the driving circuit portion, the non-driving circuit portion, the system circuit block and the display panel corresponding to the first ESD protection devices. The second ESD protection devices cooperate with the corresponding first ESD protection devices to provide the at least one discharge path.

In an embodiment of the disclosure, the one or more second ESD protection devices are all disposed in the driving circuit portion.

In an embodiment of the disclosure, the one or more second ESD protection devices are all disposed in the non-driving circuit portion.

In an embodiment of the disclosure, the one or more second ESD protection devices are disposed in at least one of the driving circuit portion, the non-driving circuit portion, the system circuit block and the display panel.

In an embodiment of the disclosure, the at least one discharge path includes one or more package test pads. The one or more package test pads are disposed in at least one of the non-driving circuit portion and the system circuit block.

In an embodiment of the disclosure, the one or more package test pads are all disposed in the non-driving circuit portion.

In an embodiment of the disclosure, the one or more package test pads are all disposed in the system circuit block.

In an embodiment of the disclosure, a first part of the one or more package test pads is disposed in the non-driving circuit portion, and a second part of the one or more package test pads is disposed in the system circuit block.

In an embodiment of the disclosure, the one or more second ESD protection devices utilize a signal routing to electrically connect the corresponding one or more first ESD protection devices, so as to cooperate with the corresponding one or more first ESD protection devices to provide the at least one discharge path. The signal routing is disposed in the non-driving circuit portion.

Based on above, in the exemplary embodiments of the disclosure, the image display system and the display driving module thereof may utilize the first ESD protection devices and the second ESD protection devices to improve the capability of ESD protection while providing the cost effectiveness.

To make the above features and advantages of the disclosure more comprehensible, several embodiments accompanied with drawings are described in detail as follows.

DESCRIPTION OF THE EMBODIMENTS

Embodiments are provided below to describe the disclosure in detail, though the disclosure is not limited to the provided embodiments, and the provided embodiments can be suitably combined.

Figure 1:
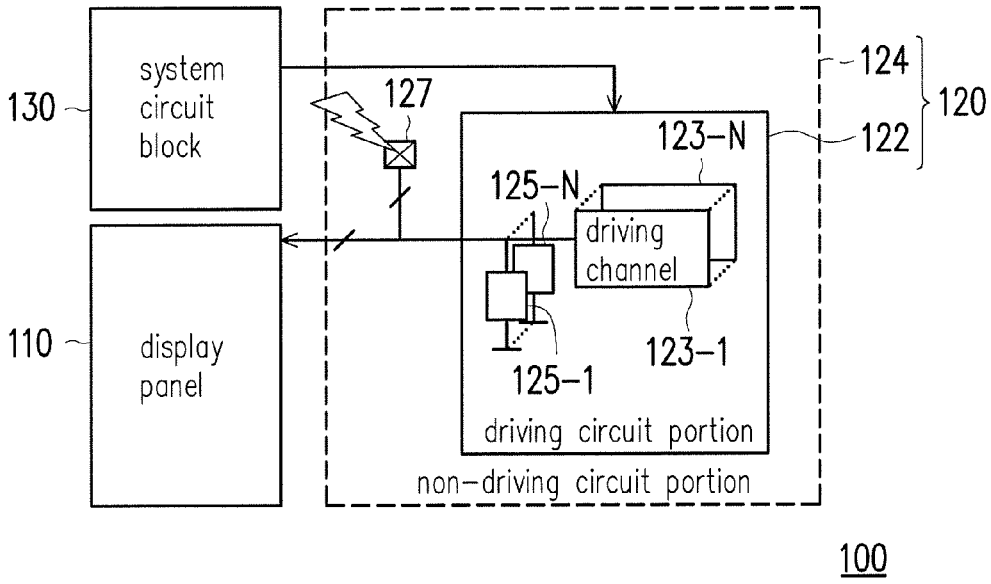
FIG. 1 is a schematic diagram illustrating an image display system according to a related example of the disclosure.

FIG. 1 is a schematic diagram illustrating an image display system according to a related example of the disclosure. Referring to FIG. 1, an image display system 100 of present related example includes a display panel 110, a display driving module 120 and a system circuit block 130. The display panel 110 is driven by the display driving module 120 to display an image frame. The system circuit block 130 provides a plurality of system control signals to control the display driving module 120. In said related example, the display driving module 120 includes a driving circuit portion 122 and a non-driving circuit portion 124. The driving circuit portion 122 includes one or more driving channels 123-1 to 123-N, for driving the display panel 110 to display the image frame. The non-driving circuit portion 124 electrically connects the driving circuit portion 122, the system circuit block 130 and the display panel 110, so as to transmit a plurality of driving signals provided by the system circuit block 130 to the driving circuit portion 122, and transmit the driving signals provided by the driving circuit portion 122 to the display panel 110.

Generally, for ESD protection, in the display driving module 120, a plurality of ESD protection devices 125-1 to 125-N are usually disposed in the driving circuit portion 122 corresponding to the driving channels 123-1 to 123-N for providing a discharge path. In the related example, the discharge path is provided by, for example, connecting the ESD protection devices 125-1 to 125-N to a corresponding package test pad 127 by utilizing a signal routing. Accordingly, during the ESD protection test, the accumulated electrostatic may be guided to outside the display driving module 120 through the signal routing to achieve the purpose of ESD protection. In said related example, the package test pad 127 is, for example, disposed in the non-driving circuit portion 124 of the display driving module 120.

Figure 2:
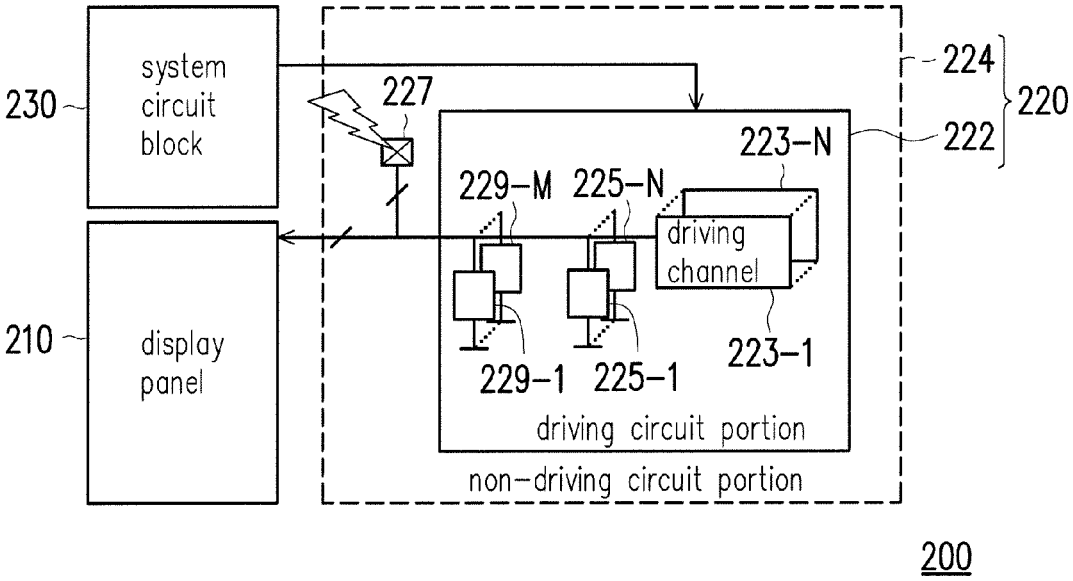
FIG. 2 is a schematic diagram illustrating an image display system according to an embodiment of the disclosure.

FIG. 2 is a schematic diagram illustrating an image display system according to an embodiment of the disclosure. Referring to FIG. 2, an image display system 200 of present embodiment includes a display panel 210, a display driving module 220 and a system circuit block 230. The display driving module 220 drives the display panel 210 to display an image frame. The system circuit block 230 provides a plurality of system control signals to control the display driving module 220. In the present embodiment, the system circuit block 230 includes but not limited to a power supply circuit or a timing control circuit, which are used to provide a power supply signal and a timing control signal, respectively, for controlling the display driving module 220. In the present embodiment, the system circuit block 230 is, for example, a system circuit disposed on a printed circuit board (PCB), but the disclosure is not limited thereto.

In the present embodiment, the display driving module 220 includes a driving circuit portion 222 and a non-driving circuit portion 224. The driving circuit portion 222 includes one or more driving channels 223-1 to 223-N, for driving the display panel 210 to display the image frame. The non-driving circuit portion 224 electrically connects the driving circuit portion 222, the system circuit block 230 and the display panel 210, so as to transmit a plurality of driving signals provided by the system circuit block 230 to the driving circuit portion 222, and transmit the driving signals provided by the driving circuit portion 222 to the display panel 210. In the present embodiment, the display driving module 220 is, for example, a package kit of the display driving chip, which includes the display driving chip and a film package. The driving circuit portion 222 of the present embodiment includes the display driving chip, which may be a source driving chip, a gate driving chip or a combination thereof. The non-driving circuit portion 224 includes said film package. The film-based package may be manufactured by using a soft material and formed on a deposited and patterned conductive metal layer.

For at least improving a capability of the ESD protection for the display driving module 220 in the present embodiment, in the display driving module 220, in addition to one or more first ESD protection devices 225-1 to 225-N for providing the discharge path, which are disposed in the driving circuit portion 222 corresponding to the driving channels 223-1 to 223-N, the driving circuit portion 222 of the present embodiment is further disposed with one or more second ESD protection devices 229-1 to 229-M corresponding to the first ESD protection devices 225-1 to 225-N. In the present embodiment, a quantity of the first ESD protection devices 225-1 to 225-N disposed in the driving circuit portion 222 is, for example, identical to a quantity of the driving channels 223-1 to 223-N, but the disclosure is not limited thereto. In another embodiment, the quantities of the two may also be different. Furthermore, in an exemplary embodiment of the disclosure, a circuit configuration for realizing the first ESD protection devices and the second ESD protection devices includes but not limited to a ground resistor, or a plurality of rectifier elements serially connected between a system voltage and a ground voltage (e.g., a diode).

In the present embodiment, the second ESD protection devices 229-1 to 229-M electrically connect the corresponding first ESD protection devices 225-1 to 225-N, so as to cooperate with the corresponding first ESD protection devices 225-1 to 225-N to provide the discharge path for improving the capability of the ESD protection for the display driving module 220. In other words, in the present embodiment, the display driving module 220 includes the first ESD protection devices 225-1 to 225-N and the second ESD protection devices 229-1 to 229-M, and the quantities of the two may be identical or different. In the present embodiment, the quantity of the second ESD protection devices 229-1 to 229-M is, for example, less than the quantity of the first ESD protection devices 225-1 to 225-N (i.e., the quantities of two are different). However, the disclosure is not limited thereto. In another embodiment, the quantity of the second ESD protection devices 229-1 to 229-M may also be greater than the quantity of the first ESD protection devices 225-1 to 225-N. Furthermore, in the present embodiment, the second ESD protection devices 229-1 to 229-M are all disposed in the non-driving circuit portion 224 of the display driving module 220, but the disclosure is not limited thereto. In other embodiments, the second ESD protection devices 229-1 to 229-M may also be partially disposed in the non-driving circuit portion 224, or may be all or partially disposed in the system circuit block 230 or the display panel 210.

In the present embodiment, the discharge path is provided by, for example, connecting the first ESD protection devices 225-1 to 225-N and the second ESD protection devices 229-1 to 229-M to corresponding one or more package test pads 227 by utilizing a signal routing. Accordingly, during the ESD protection test, the accumulated electrostatic may be guided to outside the display driving module 220 through the signal routing to achieve the purpose of ESD protection. In other words, in the present embodiment, the discharge path includes at least one package test pad 227. Furthermore, in the present embodiment, the package test pads 227 are all disposed in the non-driving circuit portion 224 of the display driving module 220, but the disclosure is not limited thereto. In other embodiments, the package test pads 227 may also be partially disposed in the non-driving circuit portion 224, or may be all or partially disposed in the system circuit block 230 or the display panel 210.

It should be noted that, in the present embodiment, although it is illustrated with only one package test pad 227 in FIG. 2 for example, such quantity is not intended to limit the disclosure. In practical application, the package test pads 227 may be one or more and designed according to the quantity of the second ESD protection devices 229-1 to 229-M, and the quantities of the two may be identical or different. In the present embodiment, the quantity of the package test pads 227 disposed in the non-driving circuit portion 224 is, for example, identical to the quantity of the second ESD protection devices 229-1 to 229-M. In another embodiment, the quantities of the two may also be different.

In the exemplary embodiments of the disclosure, no matter what the quantities and disposition positions of the second ESD protection devices 229-1 to 229-M and the package test pads 227 are, the capability of ESD protection may be effectively improved for the display driving module 220 and a cost effectiveness may also be provided.

In the embodiment of FIG. 2, the one or more package test pads are, for example, disposed in the non-driving circuit portion, but the disclosure is not limited thereto. In another embodiment, the one or more package test pads may also be disposed in the system circuit block, as shown in an embodiment illustrated in FIG. 3.

Figure 3:
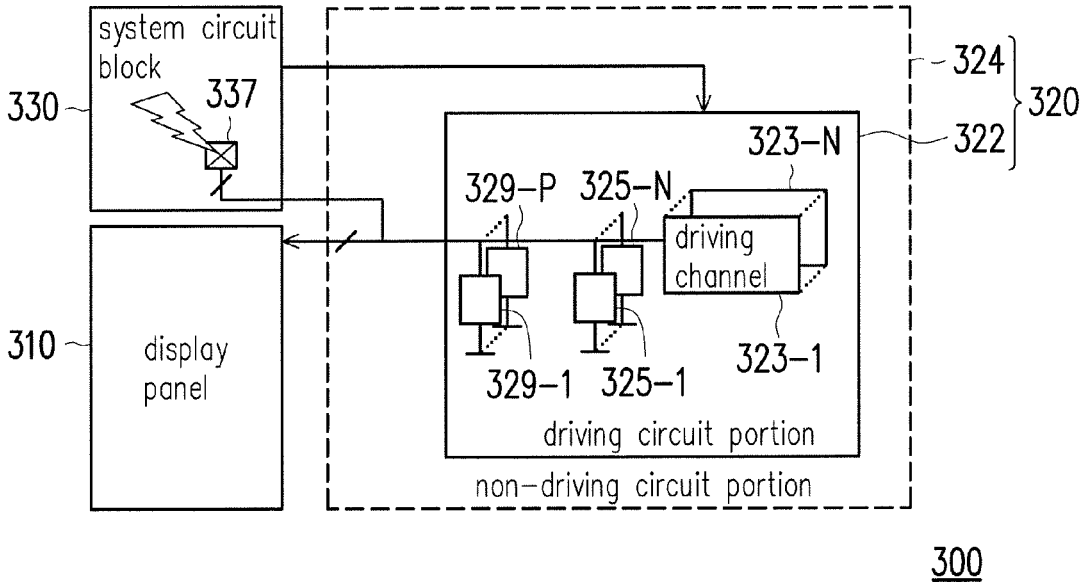
FIG. 3 is a schematic diagram illustrating an image display system according to another embodiment of the disclosure.

FIG. 3 is a schematic diagram illustrating an image display system according to another embodiment of the disclosure. Referring to FIG. 2 and FIG. 3 together, an image display system 300 of the present embodiment is similar to the image display system 200 of FIG. 2, and a major difference between the two is, for example, the disposition positions of the package test pads. Specifically, one or more package test pads 337 of the present embodiment are, for example, disposed in a system circuit block 330. Accordingly, the package test pads 337 utilize a signal routing to connect to corresponding first ESD protection devices 325-1 to 325-N and corresponding second ESD protection devices 329-1 to 329-P, so as to provide a discharge path during the ESD protection test.

It should be noted that, in the present embodiment, although it is illustrated with only one package test pad 337 in FIG. 3 for example, such quantity is not intended to limit the disclosure. In practical application, the package test pads 337 may be one or more and designed according to the quantity of the second ESD protection devices 329-1 to 329-P, and the quantities of the two may be identical or different. In the present embodiment, the quantity of the package test pads 337 disposed in the system circuit block 330 is, for example, identical to the quantity of the second ESD protection devices 329-1 to 329-P. In another embodiment, the quantities of the two may also be different.

In the embodiments of FIG. 2 and FIG. 3, the one or more package test pads are, for example, all disposed in the non-driving circuit portion 224 (FIG. 2) or the system circuit block 330 (FIG. 3), but the disclosure is not limited thereto. In other embodiments, a part of the one or more package test pads may also be disposed in the non-driving circuit portion, and another part of the package test pads may be disposed in the system circuit block, as shown in an embodiment illustrated in FIG. 4.

Figure 4:
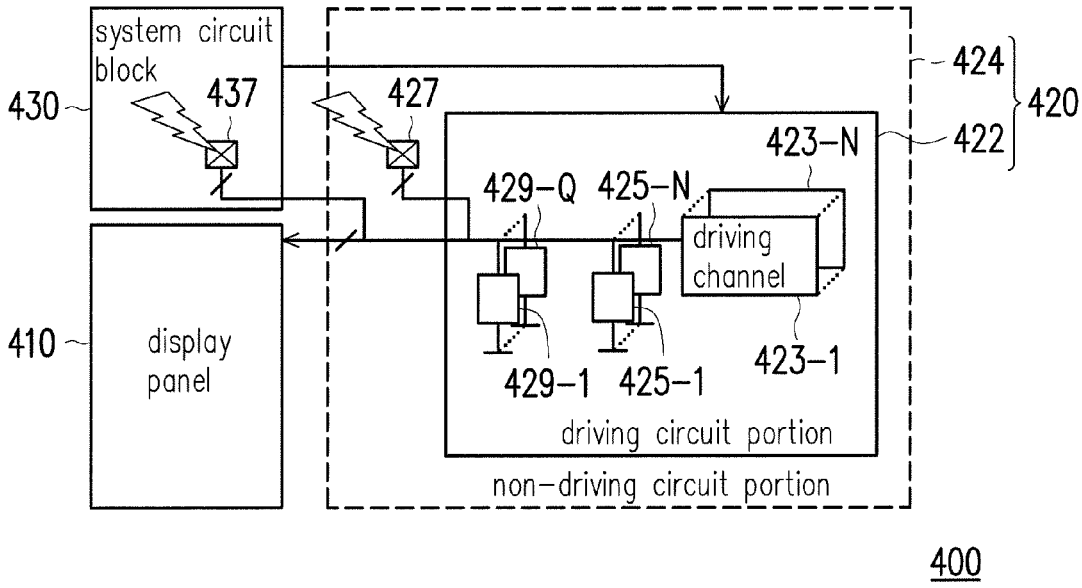
FIG. 4 is a schematic diagram illustrating an image display system according to another embodiment of the disclosure.

FIG. 4 is a schematic diagram illustrating an image display system according to another embodiment of the disclosure. Referring to FIG. 3 and FIG. 4 together, an image display system 400 of the present embodiment is similar to the image display system 200 of FIG. 2, and a major difference between the two is, for example, the disposition positions of the package test pads. Specifically, one or more package test pads 427 and 437 of the present embodiment are, for example, disposed in a non-driving circuit portion 424 and a system circuit block 430, respectively. Accordingly, the package test pads 427 and 437 respectively utilize a signal routing to connect to corresponding first ESD protection devices 425-1 to 425-N and corresponding second ESD protection devices 429-1 to 429-Q, so as to provide a discharge path during the ESD protection test.

It should be noted that, in the present embodiment, although it is illustrated with only one of the package test pads 427 and 437 respectively in the non-driving circuit portion 424 and the system circuit block 430 in FIG. 4 for example, these quantities are not intended to limit the disclosure. In practical application, the package test pads 427 and 437 may respectively be one or more and designed according to the quantity of the second ESD protection devices 429-1 to 429-Q, and a total of the quantities of the package test pads 427 and 437 may be identical to or different from the quantity of the second ESD protection devices 429-1 to 429-Q. In the present embodiment, the total of the quantity of the package test pads 437 disposed in the system circuit block 430 and the quantity of the package test pads 427 disposed in the non-driving circuit portion 424 is, for example, identical to the quantity of the second ESD protection devices 429-1 to 429-Q. In another embodiment, the total of the quantities of the package test pads 427 and 437 may also be different from the quantity of the second ESD protection devices 429-1 to 429-Q.

Moreover, in the present embodiment, a relation between the quantities of the package test pads 427 and 437 is not intended to limit the disclosure. In other words, the quantity of the package test pads 437 disposed in the system circuit block 430 may be greater than, less than, or equal to the quantity of the package test pads 427 disposed in the non-driving circuit portion 424.

In the embodiments in FIG. 2 to FIG. 4, the one or more second ESD protection devices are, for example, disposed in the driving circuit portion, but the disclosure is not limited thereto. In other embodiments, the one or more second ESD protection devices may also be disposed in the non-driving circuit portion, as shown in an embodiment illustrated in FIG. 5. Alternatively, in other embodiments, the one or more second ESD protection devices may also be disposed in the display panel, as shown in an embodiment illustrated in FIG. 6.

Figure 5:
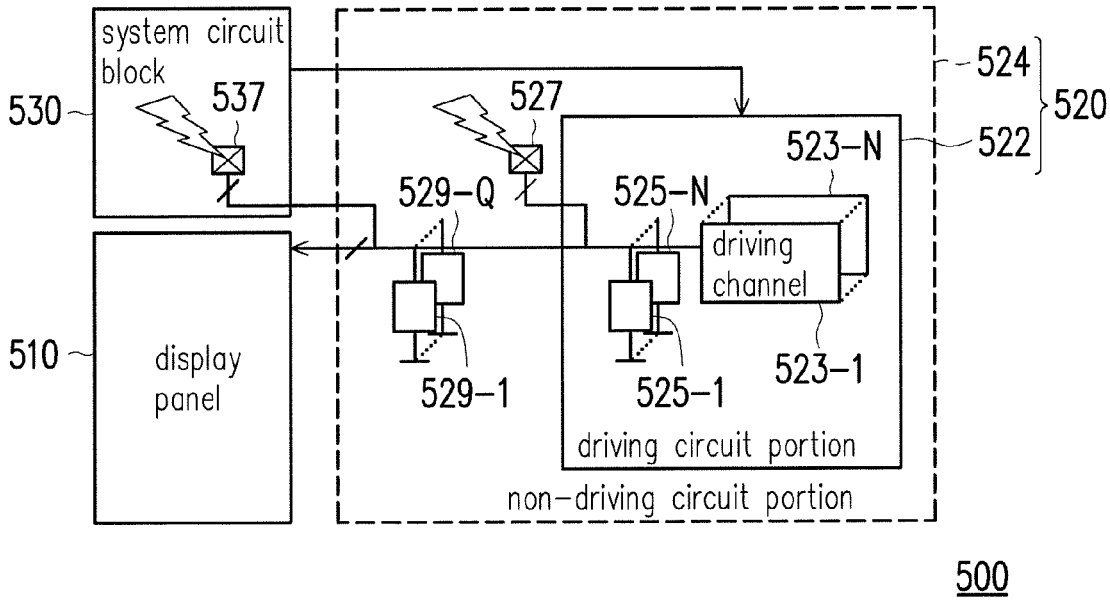
FIG. 5 is a schematic diagram illustrating an image display system according to another embodiment of the disclosure.

FIG. 5 is a schematic diagram illustrating an image display system according to another embodiment of the disclosure. Referring to FIG. 4 and FIG. 5 together, an image display system 500 of the present embodiment is similar to the image display system 400 of FIG. 4, and a major difference between the two is, for example, the disposition positions of the second ESD protection devices. Specifically, one or more second ESD protection devices 529-1 to 529-Q of the present embodiment are, for example, disposed in a non-driving circuit portion 524. The second ESD protection devices 529-1 to 529-Q respectively utilize a signal routing to connect to corresponding first ESD protection devices 525-1 to 525-N and corresponding package test pads 527 and 537, so as to cooperate with the corresponding first ESD protection devices 525-1 to 525-N to provide the discharge path for improving the capability of the ESD protection for the image display system 500.

Figure 6:
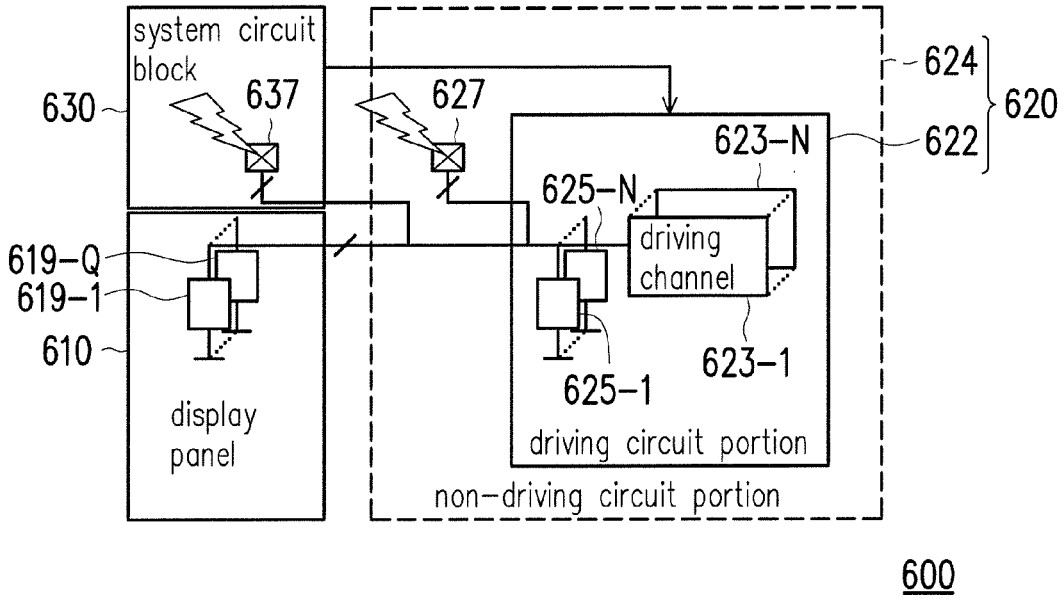
FIG. 6 is a schematic diagram illustrating an image display system according to another embodiment of the disclosure.

FIG. 6 is a schematic diagram illustrating an image display system according to another embodiment of the disclosure. Referring to FIG. 4 and FIG. 6 together, an image display system 600 of the present embodiment is similar to the image display system 400 of FIG. 4, and a major difference between the two is, for example, the disposition positions of the second ESD protection devices. Specifically, one or more second ESD protection devices 619-1 to 619-Q of the present embodiment are, for example, disposed in a display panel 610. The second ESD protection devices 619-1 to 619-Q respectively utilize a signal routing to connect to corresponding first ESD protection devices 625-1 to 625-N and corresponding package test pads 627 and 637, so as to cooperate with the corresponding first ESD protection devices 625-1 to 625-N to provide the discharge path for improving the capability of the ESD protection for the image display system 600.

In the embodiments in FIG. 4 to FIG. 6, the one or more second ESD protection devices are, for example, all disposed in the non-driving circuit portion, the system circuit block or the display panel, but the disclosure is not limited thereto. In other embodiments, the one or more second ESD protection devices may also be distributively disposed in the non-driving circuit portion, the system circuit block and the display panel. Alternatively, in other embodiments, the one or more second ESD protection devices may also be distributively disposed in any two of the non-driving circuit portion, the system circuit block and the display panel. In addition, enough teaching, suggestion, and implementation illustration for disposing configurations, operation methods and effects of the second ESD protection devices in the other two embodiments of the disclosure can be obtained from the above embodiments in FIG. 2 to FIG. 6, thus related descriptions thereof are not repeated hereinafter.

In the embodiment of FIG. 3, the one or more second ESD protection devices and the one or more package test pads are, for example, disposed in the non-driving circuit portion and the system circuit block, respectively, but the disclosure is not limited thereto. In another embodiment, the one or more second ESD protection devices and the one or more package test pads may also be collectively disposed in the system circuit block, as shown in an embodiment illustrated in FIG. 7.

Figure 7:
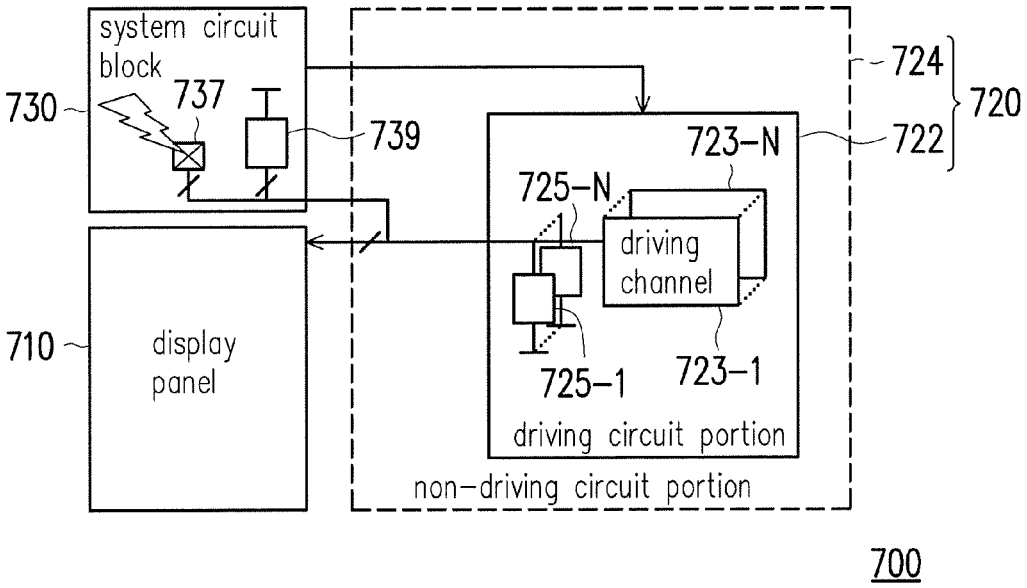
FIG. 7 is a schematic diagram illustrating an image display system according to another embodiment of the disclosure.

FIG. 7 is a schematic diagram illustrating an image display system according to another embodiment of the disclosure. Referring to FIG. 3 and FIG. 7 together, an image display system 700 of the present embodiment is similar to the image display system 300 of FIG. 3, and a major difference between the two is, for example, the disposition positions of the second ESD protection devices. Specifically, one or more second ESD protection devices 739 of the present embodiment are, for example, disposed in a system circuit block 730. The second ESD protection devices 739 respectively utilize a signal routing to connect to corresponding first ESD protection devices 725-1 to 725-N, so as to cooperate with the corresponding first ESD protection devices 725-1 to 725-N to provide the discharge path for improving the capability of the ESD protection for the image display system 700.

It should be noted that, in the present embodiment, although it is illustrated with only one second ESD protection device 739 in FIG. 7 for example, such quantity is not intended to limit the disclosure. In practical application, the second ESD protection devices 739 may be one or more and designed according to the quantity of the first ESD protection devices 725-1 to 725-N, and the quantities of the two may be identical or different. In the present embodiment, the quantity of the second ESD protection devices 739 disposed in the system circuit block 730 is, for example, different from the quantity of the first ESD protection devices 725-1 to 725-N. In another embodiment, the quantities of the two may also be designed to be identical.

Furthermore, in the present embodiment, although it is illustrated with only one package test pad 737 in FIG. 7 for example, such quantity is not intended to limit the disclosure. In practical application, the package test pads 737 may be one or more and designed according to the quantity of the second ESD protection devices 739, and the quantities of the two may be identical or different. In the present embodiment, the quantity of the package test pads 737 disposed in the system circuit block 730 is, for example, identical to the quantity of the second ESD protection devices 739. In another embodiment, the quantities of the two may also be different.

Figure 8:
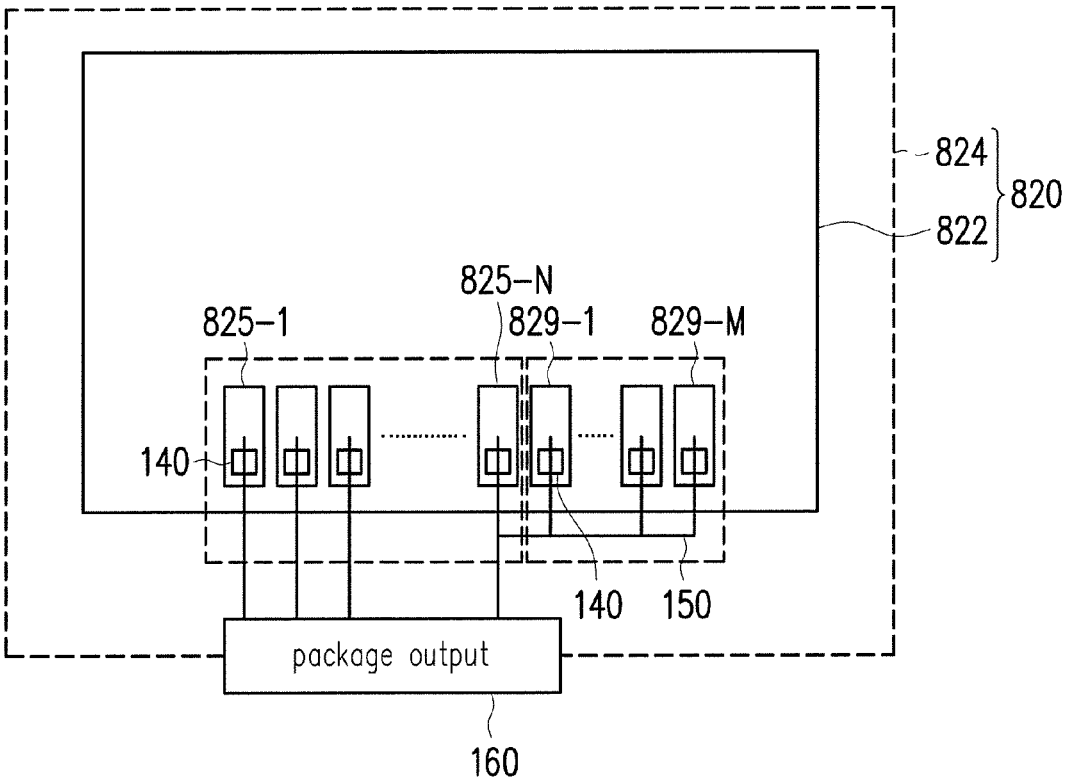
FIG. 8 is a schematic diagram illustrating a display driving module according to an embodiment of the disclosure.

FIG. 8 is a schematic diagram illustrating a display driving module according to an embodiment of the disclosure. Referring to FIG. 8, a plurality of driving channels (not illustrated) in a driving circuit portion 822 of the present embodiment is, for example, disposed with corresponding first ESD protection devices 825-1 to 825-N and electrically connected to a signal routing 150 through a bump 140. In practical application, the first ESD protection devices 825-1 to 825-N are, for example, disposed at a position in a driving circuit portion 822 near a package output 160 of a display driving module 820. In the present embodiment, the signal routing 150 for electrically connecting the first ESD protection devices 825-1 to 825-N is, for example, disposed in the non-driving circuit portions 824.

For at least improving the capability of the ESD protection for the display driving module 820 in the present embodiment, in the display driving module 820, in addition to one or more first ESD protection devices 825-1 to 825-N for providing the discharge path, which are disposed in the driving circuit portion 822, the driving circuit portion 822 of the present embodiment is further disposed with one or more second ESD protection devices 829-1 to 829-M corresponding to the first ESD protection devices 825-1 to 825-N. In the present embodiment, the second ESD protection devices 829-1 to 829-M also electrically connect the corresponding first ESD protection devices 825-1 to 825-N by utilizing the signal routing 150 disposed in the non-driving circuit portion 824, so as to cooperate with the corresponding first ESD protection devices to provide the discharge path.

In the present embodiment, it is assumed that only one second ESD protection device is disposed in the driving circuit portion 822 (i.e., M=1). In this case, the second ESD protection device 829-1 electrically connects, for example, the first ESD protection device 825-N through the bump 140 and the signal routing 150 located in the non-driving circuit portion 824, so as to cooperate with the first ESD protection device 825-N nearby to provide the discharge path for improving the capability of the ESD protection for the display driving module 820.

It should be noted that, in the present embodiment, the quantity of the second ESD protection devices is not intended to limit the disclosure. The quantity of the second ESD protection devices for electrically connecting the first ESD protection devices may be increased by changing a disposition amount of the second ESD protection devices together with a different wiring method for the signal routing 150 located in the non-driving circuit portion 824, so as to improve the capability of the ESD protection for the display driving module 820. Furthermore, the signal routing 150 illustrated in FIG. 8 is disposed in the non-driving circuit portion 824 of the display driving module 820, and a place where the signal routing 150 and the driving circuit portion 822 are overlapped indicates that the signal routing 150 is located in the non-driving circuit portion 824 under the driving circuit portion 822.

In the present embodiment, a quantity of the first ESD protection devices 825-1 to 825-N disposed in the driving circuit portion 822 is, for example, identical to a quantity of the driving channels of the driving circuit portion 822, but the disclosure is not limited thereto. In another embodiment, the quantities of the two may also be different. Furthermore, in an exemplary embodiment of the disclosure, a circuit configuration for realizing the first ESD protection devices and the second ESD protection devices includes but not limited to a ground resistor, or a plurality of rectifier elements serially connected between a system voltage and a ground voltage (e.g., a diode).

Figure 9:
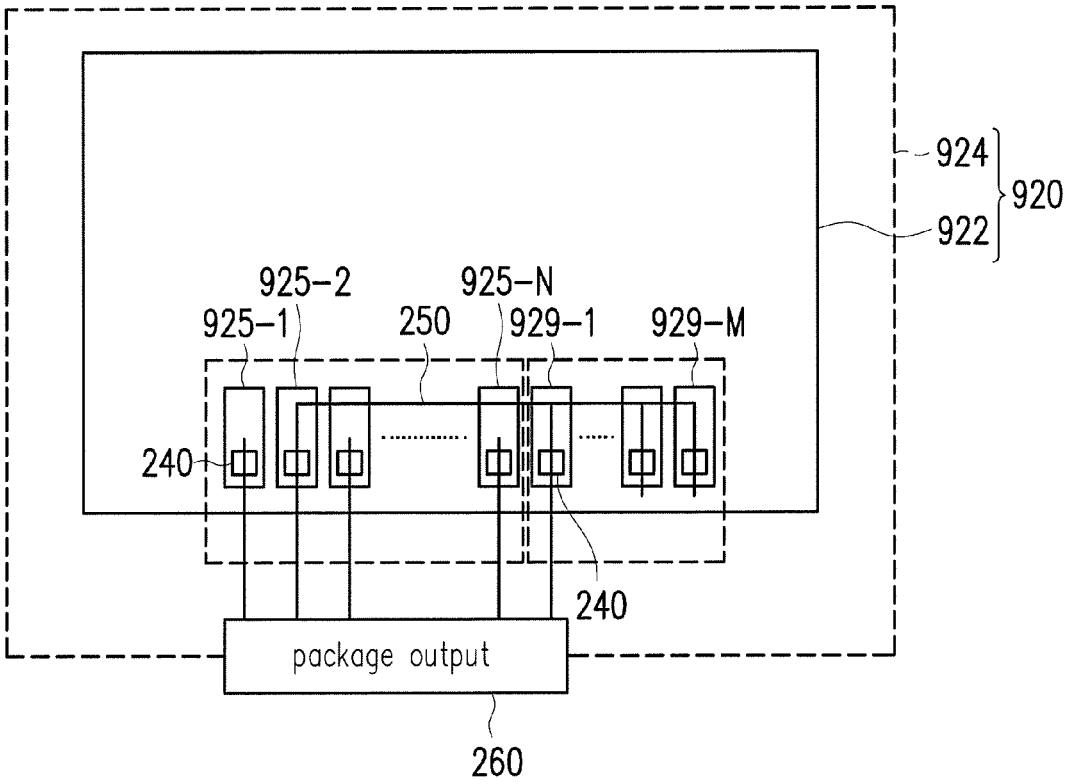
FIG. 9 is a schematic diagram illustrating a display driving module according to another embodiment of the disclosure.

FIG. 9 is a schematic diagram illustrating a display driving module according to another embodiment of the disclosure. Referring to FIG. 8 and FIG. 9 together, a display driving module 920 of the present embodiment is similar to the display driving module 820 of FIG. 8, a major difference between the two is that the first ESD protection device to which the second ESD protection device cooperates with is different, such that the wiring method for a signal routing 250 is changed accordingly.

In the present embodiment, it is assumed that only one second ESD protection device is disposed in the driving circuit portion 922 (i.e., M=1). In this case, a second ESD protection device 929-1 electrically connects, for example, a first ESD protection device 925-2 through a bump 240 and the signal routing 250 located in a non-driving circuit portion 924, so as to cooperate with the first ESD protection device 925-2 to provide the discharge path for improving the capability of the ESD protection for the display driving module 920.

In the embodiments in FIG. 8 to FIG. 9, the signal routings 150 and 250 are disposed in the non-driving circuit portions 824 and 924, respectively. In the present embodiments of the disclosure, the driving circuit portion includes the display driving chip, and the non-driving circuit portion includes the film package. Therefore, after the manufacturing process of the display driving chip and the film package including the first ESD protection devices and the second ESD protection devices is completed, the designer may still utilize the wiring method for the signal routing on the non-driving circuit portion based on actual design requirements, so as to adjust a target and a quantity of the second ESD protection devices for providing the discharge path, and adjust a target and a quantity of the first ESD protection devices to be cooperated with. Accordingly, the first ESD protection devices and the second ESD protection devices are capable of improving the capability of ESD protection for the display driving chip while providing the cost effectiveness.

In addition, enough teaching, suggestion, and implementation illustration for disposing configurations, operation methods and effects of other circuitry blocks and elements in the embodiments of FIG. 7 and FIG. 8 can be obtained from the above embodiments in FIG. 2 to FIG. 7, thus related descriptions thereof are not repeated hereinafter.

In summary, in the exemplary embodiments of the disclosure, the image display system and the display driving module thereof may include the second ESD protection devices, which are disposed in at least one of the driving circuit portion, the non-driving circuit portion, the system circuit block and the display panel, so as to cooperate with the corresponding first ESD protection devices for providing the discharge path. Furthermore, the package test pads on the discharge path may be disposed in at least one of the non-driving circuit portion and the system circuit block. Accordingly, the image display system and the display driving module thereof may utilize the first ESD protection devices and the second ESD protection devices to improve the capability of ESD protection while providing the cost effectiveness.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A display driving module, comprising:

a driving circuit portion, controlled by a system circuit block and comprising one or more driving channels configured to drive a display panel; and a non-driving circuit portion configured to connect the system circuit block, the driving circuit portion and the display panel, wherein one or more first electrostatic discharge (ESD) protection devices are disposed in the driving circuit portion, and provide at least one discharge path for the one or more driving channels, wherein one or more second ESD protection devices are disposed in at least one of the driving circuit portion, the non-driving circuit portion, the system circuit block and the display panel, and cooperate with the one or more first ESD protection devices to provide the at least one discharge path.

2. The display driving module of claim 1, wherein the one or more second ESD protection devices are all disposed in the driving circuit portion.

3. The display driving module of claim 1, wherein the one or more second ESD protection devices are all disposed in the non-driving circuit portion.

4. The display driving module of claim 1, wherein the one or more second ESD protection devices are disposed in at least one of the driving circuit portion, the non-driving circuit portion, the system circuit block and the display panel.

5. The display driving module of claim 1, wherein the at least one discharge path comprises one or more package test pads, and the one or more package test pads are disposed in at least one of the non-driving circuit portion and the system circuit block.

6. The display driving module of claim 5, wherein the one or more package test pads are all disposed in the non-driving circuit portion.

7. The display driving module of claim 5, wherein the one or more package test pads are all disposed in the system circuit block.

8. The display driving module of claim 5, wherein a first part of the one or more package test pads is disposed in the non-driving circuit portion, and a second part of the one or more package test pads is disposed in the system circuit block.

9. The display driving module of claim 1, wherein the one or more second ESD protection devices utilize a signal routing to connect the corresponding one or more first ESD protection devices, so as to cooperate with the corresponding one or more first ESD protection devices to provide the at least one discharge path, wherein the signal routing is disposed in the non-driving circuit portion.

10. An image display system, comprising:

a display panel configured to display an image frame;

a display driving module, comprising:

a driving circuit portion, comprising one or more driving channels configured to drive the display panel to display the image frame; and a non-driving circuit portion configured to connect the driving circuit portion and the display panel; and a system circuit block configured to provide a plurality of system control signals to control the display driving module, wherein one or more first electrostatic discharge (ESD) protection devices are disposed in the driving circuit portion, and provide at least one discharge path for the one or more driving channels, wherein one or more second ESD protection devices are disposed in at least one of the driving circuit portion, the non-driving circuit portion, the system circuit block and the display panel, and cooperate with the one or more first ESD protection devices to provide the at least one discharge path.

11. The image display system of claim 10, wherein the one or more second ESD protection devices are all disposed in the driving circuit portion.

12. The image display system of claim 10, wherein the one or more second ESD protection devices are all disposed in the non-driving circuit portion.

13. The image display system of claim 10, wherein the one or more second ESD protection devices are disposed in at least one of the driving circuit portion, the non-driving circuit portion, the system circuit block and the display panel.

14. The image display system of claim 10, wherein the at least one discharge path comprises one or more package test pads, and the one or more package test pads are disposed in at least one of the non-driving circuit portion and the system circuit block.

15. The image display system of claim 14, wherein the one or more package test pads are all disposed in the non-driving circuit portion.

16. The image display system of claim 14, wherein the one or more package test pads are all disposed in the system circuit block.

17. The image display system of claim 14, wherein a first part of the one or more package test pads is disposed in the non-driving circuit portion, and a second part of the one or more package test pads is disposed in the system circuit block.

18. The image display system of claim 10, wherein the one or more second ESD protection devices utilize a signal routing to connect the corresponding one or more first ESD protection devices, so as to cooperate with the corresponding one or more first ESD protection devices to provide the at least one discharge path, wherein the signal routing is disposed in the non-driving circuit portion.

* * * * *